US006170447B1

(12) United States Patent
Kohrs et al.

(10) Patent No.: US 6,170,447 B1
(45) Date of Patent: Jan. 9, 2001

(54) INNER SEAL FOR A CAMSHAFT ADJUSTING DEVICE IN AN INTERNAL COMBUSTION ENGINE, SPECIALLY A BLADE CELL ADJUSTING DEVICE

(75) Inventors: Mike Kohrs, Wilthen; Jochen Auchter, Aurachtal; Jens Schafer, Herzogenaurach, all of (DE)

(73) Assignee: Ina Schaeffler oHG (DE)

( * ) Notice: Under 35 U.S.C. 154(b), the term of this patent shall be extended for 0 days.

(21) Appl. No.: 09/402,865

(22) PCT Filed: Nov. 6, 1997

(86) PCT No.: PCT/EP97/06169

§ 371 Date: Oct. 8, 1999

§ 102(e) Date: Oct. 8, 1999

(87) PCT Pub. No.: WO98/46864

PCT Pub. Date: Oct. 22, 1998

(51) Int. Cl.[7] ..... F01L 1/344
(52) U.S. Cl. ..... 123/90.17; 123/90.37
(58) Field of Search ..... 123/90.15, 90.17, 123/90.31, 90.37; 74/568 R

(56) References Cited

U.S. PATENT DOCUMENTS

| | | | | |
|---|---|---|---|---|
| 4,858,572 | | 8/1989 | Shirai et al. | 123/90.12 |
| 5,724,929 | * | 3/1998 | Mikame et al. | 123/90.17 |
| 5,813,378 | * | 9/1998 | Sato | 123/90.17 |
| 5,875,750 | * | 3/1999 | Iwasaki et al. | 123/90.17 |

FOREIGN PATENT DOCUMENTS 3922962 1/1991 (DE) .

OTHER PUBLICATIONS

Patent Abstracts of Japan, 1 page, 07238815, Dec. 1985, Akira.

* cited by examiner

*Primary Examiner*—Weilun Lo
(74) *Attorney, Agent, or Firm*—Biermzan, Muserlian and Lucas

(57) ABSTRACT

An internal sealing of a vane-type adjusting device comprising a drive pinion (2) connected to a crankshaft of an internal combustion engine by a toothed belt or a timing chain and has a hollow space (9) into which a winged wheel (13) is inserted and rotationally fixed to a camshaft of an internal combustion engine, the drive pinion (2) comprising on the inner surface of its circumferential wall (3) at least one working chamber (5), and the wings of the winged wheel (13) divide each working chamber (5) into two pressure chambers (10, 11) and to avoid pressure medium leakage between the pressure chambers (10, 11) of each working chamber (5) and between the individual working chambers (5), each wing of the winged wheel (13) is configured as a separate wing segment (18) which is displaceable within a guide (15) in the winged wheel (13) and is sealed leak-tight radially by the radial centrifugal force which results from the rotation of the vane-type adjusting device (1) during engine operation, and axially by at least one prestressed axial sealing element (23).

4 Claims, 1 Drawing Sheet

INNER SEAL FOR A CAMSHAFT ADJUSTING DEVICE IN AN INTERNAL COMBUSTION ENGINE, SPECIALLY A BLADE CELL ADJUSTING DEVICE

This application is a 371 of PCT/EP97/0619 filed Nov. 6, 1997.

FIELD OF THE INVENTION

The invention concerns an internal sealing of a camshaft-adjusting device in an internal combustion engine, particularly a vane-type adjusting device comprising a drive pinion configured as an outer rotor which is connected to a crankshaft of an internal combustion engine by a toothed belt or a timing chain or by gears, said drive pinion comprising a hollow space defined by a circumferential wall and two side walls, a toothing being provided on the outer surface of the circumferential wall and at least one working chamber having limiting walls directed toward the central longitudinal axis of the drive pinion being made in the inner surface of the circumferential wall, a winged wheel which has at least one radial wing and is configured as an inner rotor rotationally fixed to the camshaft being inserted into the hollow space of the drive pinion, wings of the winged wheel dividing each working chamber into two pressure chambers which, when pressurized successively or simultaneously by a pressure oil, effect a rotation and/or an infinitely variable hydraulic clamping of the camshaft relative to the crankshaft.

BACKGROUND OF THE INVENTION

In vane-type adjusting devices of the aforesaid type commonly known in the art, the sealing of the pressure chambers in the hollow space of the drive pinion against pressure oil leakage is generally effected on the one hand by two narrow radial gaps arranged between the wings of the winged wheel and the circumferential wall and between the hub of the winged wheel and the circumferential wall of the drive pinion, and on the other hand by two narrow axial gaps between the side walls of the wings of the winged wheel and the side walls of the drive pinion. From the manufacturing point of view, it is, however, not possible, or possible only at very high expense, to make two narrow or sealing gaps in radial direction in such vane-type adjusting devices because this results in an overdetermination between the winged wheel and the drive pinion so that one of the radial gaps inevitably does not seal as intended. In spite of complicated manufacturing and a perfect fit of the individual parts of such adjusting devices, increasing leakage of the pressure oil through the radial and axial gaps in excess of the restricted leakage required, per se, occurs with increasing temperature of the pressure oil during engine operation. This leads to a reduction of the oil supply pressure and thus to retarded adjustment and a too weak hydraulic clamping of the winged wheel and thus of the camshaft. This has a strong detrimental effect at high oil temperatures because the viscosity and the oil supply pressure are then particularly low so that a frequent re-adjustment of the adjusting positions given by the characteristic diagram of engine timing is required and/or higher oil flow rates have to be provided for.

From another actuating device for a camshaft disclosed in DE-OS 39 22 962, it is further known to make axial and radial grooves in the wings of the winged wheel and arrange spring-mounted seals in these grooves to sealingly cooperate with the circumferential wall and the side walls of the hollow space of the drive pinion.

The manufacturing of vane-type adjusting devices with such sealing measures has proved to be very complicated and expensive, and, due to the transition junctions between the individual axial and radial seals, these sealing measures cannot assure a satisfactory reduction of leakage values.

OBJECT OF THE INVENTION

It is therefore the object of the invention to conceive an internal sealing for a camshaft adjusting device of an internal combustion engine, particularly a vane-type adjusting device, with which undesired pressure oil leakage between the pressure chambers in the hollow space of the drive pinion can be reduced to a minimum by simple and cost-effective means.

SUMMARY OF THE INVENTION

This object is achieved according to the invention in a vane-type adjusting device by the fact that each wing of the winged wheel is configured as a separate wing segment which is displaceable within a guide in the winged wheel and exhibits a distance both radially from the circumferential wall of the drive pinion in the respective working chamber and axially from the side walls of the drive pinion, which distance is sealed leak-tight radially by the radial centrifugal force which results from the rotation of the vane-type adjusting device during engine operation and acts on the wing segment, and axially by least one prestressed axial sealing element.

The vane-type adjusting device configured according to the invention thus contrasts positively with the state of the art in that the fabrication of the winged wheel is substantially simplified and, at the same time, the leakage values in the hollow space of the drive pinion are minimized to the greatest possible extent. It is true that the winged wheel configured according to the invention comprises more individual elements than hitherto usual but these elements do not have to be made to the close tolerances required in prior art vane-type adjusting devices which have a disadvantageous effect on the time and costs involved in the manufacturing of the vane-type adjusting device. Additionally, due to the inventive separation of the wings of the winged wheel from the hub of the winged wheel, an overdetermination between the hub, the winged wheel and the drive pinion is no longer possible so that an exact radial sealing gap can be obtained between the hub of the winged wheel and the circumferential wall of the drive pinion.

In an advantageous embodiment of the invention, the guide for each wing segment is made in the hub of the winged wheel preferably as a radial groove which extends parallel to the central longitudinal axis, has axial side walls parallel to each other and surrounds the inserted, preferably cuboid wing segment approximately up to half of its height. The optimum solution with regard to achieving the desired angle of adjustment between the crankshaft and the camshaft as well as the required adjusting speed and hydraulic clamping force is to provide three such radial grooves uniformly spaced on the hub of the winged wheel and arrange three identical wing segments in these radial grooves. The scope of protection of the invention, however, also extends to configurations in which the winged wheel has less than three or even more than three wing segments, and/or configurations in which the wing segments are surrounded by the radial grooves to a higher or even a lower level than half their height. Similarly, the preferred cuboid configuration of the wing segments is only one of several possible shapes because with such wing segments, it is possible to achieve a relatively long radial sealing gap and thus a high degree of leak-tightness between the pressure chambers in each working chamber.

According to a further feature of the invention, the sealing surface of each wing segment cooperating with the circumferential wall of the drive pinion in each working chamber therefore preferably has in radial direction, the same radius and in axial direction, the same surface contour as the circumferential wall in each working chamber. In contrast, the bottom surface of each wing segment situated opposite this sealing surface, which may also have a smaller radius, preferably has a straight configuration, so that the wing segment, at the same time, possesses good sliding properties within the working chamber during the adjusting operation, and a canting or tilting of the wing segments within the guides is substantially excluded. Pressure medium leakage through the gaps formed on a side wall of the guide and/or under the bottom surface of the wing segments due to the radial movability of the wing segments is likewise substantially excluded because the pressure of the pressure medium prevailing in a pressure chamber at any time is likewise present in these gaps. As is the case with steel sealing rings, this pressure effects, on the one hand, that the wing segments are sealingly pressed against the side wall of the guide opposing the direction of pressure and on the other hand, the radial centrifugal force of the wing segments is assisted by a radial pressure force which enhances the sealing action of the wing segments on the circumferential wall in the working chambers. In addition, it is also possible to further assist the radial centrifugal force of the wing segments by providing spring elements such as bent girders, compression springs or the like which act radially on the bottom surface of the wing segments to further intensify the sealing action thereof.

Finally, according to a further feature of the inventive sealing of a vane-type adjusting device, the axial sealing elements on each wing segment are made as steel sealing strips arranged in axial grooves extending over their entire height. These steel sealing strips are prestressed by spring elements such as compression springs, leaf springs or elastomer elements acting on their groove-proximate longitudinal edges. A satisfactory sealing action between the pressure chambers in axial direction is obtained already by arranging a steel sealing strip only on one of the axial ends of the wing segments in such an axial groove but it is also possible to arrange one or more steel sealing strips on both axial ends of each wing segment to cooperate with the side walls of the drive pinion or, instead, to use sealing strips made of a plastic material, rubber or non-ferrous materials. The steel sealing strips preferably have a square cross-section whose width corresponds approximately to the width of the complementary axial groove and whose height, if compression springs are used for pre-stressing them, is slightly larger than the depth of the axial groove. If only one steel sealing strip is arranged on each wing segment, the compression springs are disposed in pocket bores starting from the groove bottom of the axial groove. However, the most advantageous solution is to provide two compression springs and two pocket bores for each steel sealing strip. When using two steel sealing strips for each wing segment, the compression springs are arranged in through-bores extending from groove bottom to groove bottom so that the steel sealing strips of each wing segment support each other. If the prestress of the steel sealing strips is produced by using leaf springs or elastomer elements instead of compression springs, the depth of the axial groove has to be increased by the height of the leaf springs or elastomer elements if these extend continuously over the entire length of the axial groove. In contrast, pointwise acting elastomer elements can be arranged in the wing segments of the winged wheel in the same manner as compression springs. It is, however, also possible to configure the axial sealing elements as sealing strips with a circular or other suitable profile cross-section and/or to arrange the axial sealing elements in the axial grooves without prestress and realize the pressing function of the spring elements in the same manner as when steel sealing rings are used, i.e. through the pressure of the hydraulic pressure medium.

BRIEF DESCRIPTION OF THE DRAWINGS

The invention is described more closely in the following with reference to the drawings in which.

DETAILED DESCRIPTION OF THE DRAWINGS

Figure 1:
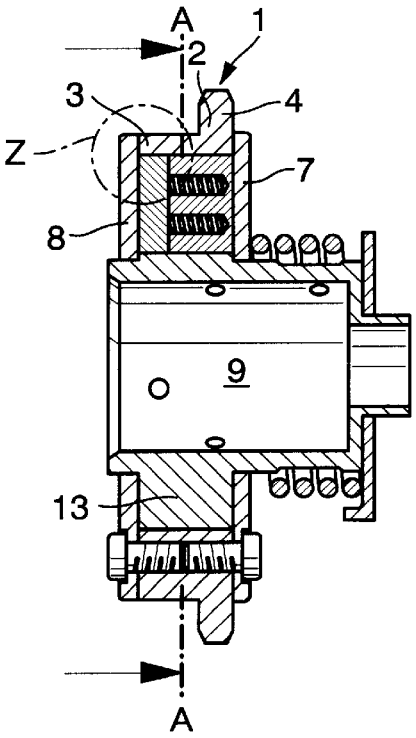
FIG. 1 shows a longitudinal section through a vane-type adjusting device having a sealing according to the invention.
Figure 2:
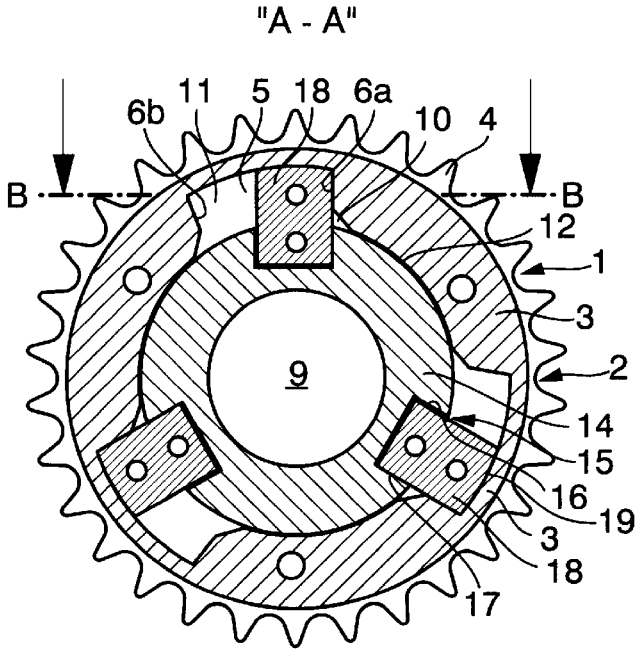
FIG. 2 shows a section taken along line A—A of FIG. 1.

FIGS. 1 and 2 show different views of a vane-type adjusting device which comprises in a known manner, a drive pinion 2 configured as an outer rotor and a winged wheel 13 configured as an inner rotor. The drawings do not show that in the present case, the drive pinion 2 is connected to a crankshaft of an internal combustion engine by a timing chain and the winged wheel 13 is rotationally fixed on a camshaft of an internal combustion engine. It can be seen in the drawings that the drive pinion 2 comprises a hollow space 9 defined by a circumferential wall 3 and two side walls 7, 8, there being provided on the outer surface of the circumferential wall 3, a toothing 4 and on the inner surface of the circumferential wall 3, three working chambers 5 each of which has limiting walls 6*a,* 6*b* directed towards the central longitudinal axis of the drive pinion 2. The winged wheel 13, which in the present case is configured with three radial wings, is inserted into this hollow space 9 of the drive pinion 2, and the wings of the winged wheel 13 divide each working chamber 5 into two pressure chambers 10, 11 which, when pressurized successively or simultaneously by a pressure oil, effect a rotation and/or an infinitely variable clamping of the camshaft relative to the crankshaft.

To avoid pressure medium leakage between the pressure chambers 10, 11 in the working chambers 5, each wing of the winged wheel 13, as can be seen in FIG. 2, is configured according to the invention as a separate wing segment 18 which is displaceable in a guide 15 in the winged wheel 13 and, during a standstill of the vane-type adjusting device 1, said wing segment 18 exhibits a distance both radially from the circumferential wall 3 of the drive pinion 2 within the respective working chamber 5 and axially from the side walls 7, 8 of the drive pinion 2. This distance, not referenced in the drawings, is sealed leak-tight, as schematically indicated in FIG. 2, radially by the radial centrifugal force which results during the operation of the engine from the rotation of the vane-type adjusting device 1 and acts on the wing segment 18, and axially, as can be seen in FIG. 3, by a prestressed axial sealing element 23.

It can be further seen in FIG. 2 that the guide 15 for each wing segment 18 is made in the hub 14 of the winged wheel 13 as a radial groove extending parallel to the central longitudinal axis and having axial side walls 16, 17 parallel to each other. Corresponding to the number of wings of the winged wheel 13, three such radial grooves are arranged equally spaced on the hub 14 of the winged wheel 18 (13). A cuboid wing segment 18 is arranged in each of these radial grooves so as to be surrounded approximately up to half of its height by the guide 15. The sealing surface 19 of each wing segment 18 cooperating with the circumferential wall 3 of the drive pinion 3 of each working chamber 5 has in radial direction, the same radius and in axial direction, the same surface contour as the circumferential wall 3 in each working chamber 5 so as to exclude tilting or canting of the wing segments 18 within the guides 15 and create relatively long radial sealing gaps between the pressure chambers 10, 11 in each working chamber 5. Sealing between the individual working chambers 5 in the circumferential wall 3 of the drive pinion 2 relative to each other is further achieved by the sealing gaps situated between the hub 14 of the winged wheel 13 and the circumferential wall 3 of the drive pinion 2 and identified in FIG. 2 by the reference numeral 12.

Figure 3:
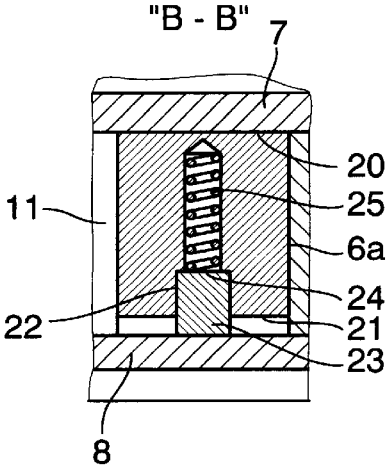
FIG. 3 shows a section taken along line B—B of FIG. 2.
Figure 4:
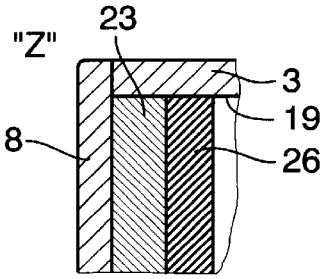
FIG. 4 shows the detail Z of FIG. 1 with the use of elastomer elements.

FIG. 3 further shows that the axial sealing elements 23 on each wing segment 18 are configured as steel sealing strips and arranged in axial grooves 22 extending on their axial end 21 over their entire height. The steel sealing strips have a square cross section with a width corresponding approximately to the width of the axial groove 22 and a height which is slightly larger than the depth of the axial groove 22. Two compression springs 25 acting pointwise on the groove-proximate longitudinal edges 24 of the steel sealing strips are arranged in pocket bores, not referenced, starting from the groove bottom of the axial groove 22. These compression springs 25 produce a prestress on the axial sealing elements so that the pressure chambers 10, 11 in each working chamber 5 are also sealed from each other in axial direction. Alternatively, the prestress on the axial sealing elements may also be produced, as shown in FIG. 4, by replacing the compression springs 25 of the steel sealing strips by elastomer elements 26 which are arranged in axial grooves 22 of adequate depth and which act linearly on the groove-proximate longitudinal edges 24 of the axial sealing elements 23.

What is claimed is:

1. Camshaft adjusting device for an internal combustion engine, including a vane-type adjusting device comprising a drive pinion (2) configured as an outer rotor which is connected to a crankshaft of an internal combustion engine by a toothed belt or a timing chain or by gears, said drive pinion (2) comprising a hollow space (9) defined by a circumferential wall (3) and two side walls (7, 8), a toothing (4) being provided on the outer surface of the circumferential wall (3) and at least one working chamber (5) having limiting walls (6*a*, 6*b*) directed toward the central longitudinal axis of the drive pinion (2) being made in the inner surface of the circumferential wall (3), a winged wheel (13) which has at least one radial wing and is configured as an inner rotor rotationally fixed to a camshaft being inserted into the hollow space (9) of the drive pinion (2), wings of the winged wheel (13) dividing each working chamber (5) into two pressure chambers (10, 11) which, when pressurized successively or simultaneously by a pressure oil, effect a rotation and/or an infinitely variable hydraulic clamping of the camshaft relative to the crankshaft, characterized in that each wing of the winged wheel (13) is configured as a separate wing segment (18) which is displaceable within a guide (15) in the winged wheel (13) and exhibits a distance both radially from the circumferential wall (3) of the drive pinion (2) in the respective working chamber (5) and axially from the side walls (7, 8) of the drive pinion (2), which distance is sealed leak-tight radially by a sealing gap (12) between the end sealing surface (19) of the wing segment (18) and the circumferential wall (3) of the drive pinion (2), which sealing gap narrows under the action of centrifugal force during rotation of the vane-type adjusting device, and said distance is sealed axially by least one prestressed axial sealing element (23) arranged on an axial end (20 or 21) of the wing segment (18).

2. Camshaft adjusting device according to claim 1, characterized in that the guide (15) for each wing segment (18) is made in the hub (14) of the winged wheel (13) as an axial groove which extends parallel to the central longitudinal axis, has lateral surfaces (16, 17) parallel to each other and surrounds the inserted wing segment (18) approximately up to half of its height.

3. Camshaft adjusting device according to claim 1, characterized in that the end sealing surface (19) of each wing segment (18) has in radial direction, the same radius and in axial direction, the same surface contour as the circumferential wall (3) of the drive pinion (2) in the respective working chamber (5).

4. Camshaft adjusting device according to claim 1, characterized in that the axial sealing elements (23) arranged on at least one axial end (20 or 21) of each wing segment (18) are configured as steel sealing strips which are arranged in radial grooves (22) extending over the entire height of the wing segments (18) in the respective axial end (20, 21), said axial sealing elements (23) being prestressed by spring elements including compression springs (25) and elastomer elements (26), acting on their groove-proximate longitudinal edge (24).

* * * * *